US011127389B2

(12) United States Patent
Sugai

(10) Patent No.: US 11,127,389 B2
(45) Date of Patent: Sep. 21, 2021

(54) NOISE CONTROL SYSTEM

(71) Applicant: ALPINE ELECTRONICS, INC., Tokyo (JP)

(72) Inventor: Taku Sugai, Iwaki (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 17/123,506

(22) Filed: Dec. 16, 2020

(65) Prior Publication Data

US 2021/0225351 A1 Jul. 22, 2021

(30) Foreign Application Priority Data

Jan. 16, 2020 (JP) ..... JP2020-005471

(51) Int. Cl.
*G10K 11/178* (2006.01)
*G10K 15/02* (2006.01)

(52) U.S. Cl.
CPC .... *G10K 11/17813* (2018.01); *G10K 11/1781* (2018.01); *G10K 11/17825* (2018.01); *G10K 11/17835* (2018.01); *G10K 11/17854* (2018.01); *G10K 11/17881* (2018.01); *G10K 11/17883* (2018.01); *G10K 15/02* (2013.01); *G10K 2210/121* (2013.01); *G10K 2210/1282* (2013.01); *G10K 2210/3032* (2013.01); *G10K 2210/3055* (2013.01); *G10K 2210/511* (2013.01)

(58) Field of Classification Search
CPC ..... G10K 11/1781; G10K 11/17883; G10K 11/17835; G10K 11/17825; G10K 2210/121; G10K 2210/511; G10K 2210/1282
See application file for complete search history.

(56) References Cited

U.S. PATENT DOCUMENTS

2011/0280410 A1* 11/2011 Matono ..... G10K 11/17854 381/71.1

FOREIGN PATENT DOCUMENTS

JP 2000-099037 4/2000

* cited by examiner

*Primary Examiner* — Ping Lee
(74) *Attorney, Agent, or Firm* — Crowell & Moring LLP

(57) ABSTRACT

An active noise control unit generates a noise canceling sound of a single frequency that cancels engine sound heard by an occupant and outputs the noise canceling sound to a speaker through an amplifier. A second harmonic detector and a third harmonic detector detect a magnitude of a harmonic component of the noise canceling sound included in sound collected by a microphone. A controller controls a frequency of the noise canceling sound generated by the active noise control unit to a fundamental frequency of the engine sound based on a rotation frequency of the engine, and in addition, causes an output level control unit to control a level of the noise canceling sound to be output to the amplifier so that the level of the noise canceling sound becomes higher when the magnitude of the harmonic component exceeds a predetermined threshold value.

20 Claims, 4 Drawing Sheets

NOISE CONTROL SYSTEM

RELATED APPLICATION

The present application claims priority to Japanese Patent Application Number 2020-005471, filed Jan. 16, 2020, the entirety of which is hereby incorporated by reference.

BACKGROUND

1. Field of the Invention

The present invention relates to a noise control technique for reducing noise by radiating a noise canceling sound that cancels the noise.

2. Description of the Related Art

As a noise control technique that reduces noise by radiating a noise canceling sound that cancels noise, an active noise control (ANC) device that determines an engine sound of an automobile as noise has been used to reduce the engine noise heard by an occupant (for example, Japanese Unexamined Patent Publication No. 2000-99037).

The active noise control device for reducing an engine sound reduces an engine sound heard by a vehicle occupant by generating a cosine wave signal and a sine wave signal of the same single frequency as a fundamental frequency of the engine sound, generating a noise canceling sound of a single frequency by adding to each other a signal obtained by causing the generated cosine wave signal to pass an adaptive filter and a signal obtained by causing the sine wave signal to pass an adaptive filter, and radiating the generated noise canceling sound from a speaker through an amplifier. Note that a transfer function of each of the adaptive filters is updated so that the engine sound collected by a microphone is minimized by a predetermined adaptive operation.

According to the above-mentioned active noise control device, changes in output characteristics of the amplifier and the speaker caused by changes in environmental conditions, such as temperature, cause harmonic distortion in the output characteristics and an increase in a harmonic component of a frequency that is an integral multiple of a frequency of the noise canceling sound, and accordingly, the occupant may hear the sound as an abnormal noise. Specifically, in a low temperature environment, for example, harmonic distortion may occur in the output characteristics of the speaker, and an abnormal noise of the harmonic of a noise canceling sound may be heard by the occupant.

SUMMARY

Accordingly, it is an object of the present disclosure to provide a noise control system that suppresses output of harmonic noise of a noise canceling sound for canceling noise.

To address the problem described above, according to the present disclosure, a noise control system that reduces noise includes an audio output unit configured to include a speaker, a control frequency detection unit configured to detect a single frequency serving as a main frequency of the noise as a control frequency, a noise control unit configured to generate noise canceling sound of the control frequency that cancels the noise and output the generated noise canceling sound to the audio output unit so as to output the noise canceling sound from the speaker, an output level control unit configured to control a level of the noise canceling sound to be output from the noise control unit to the audio output unit, a microphone, and a harmonic detection unit configured to detect, as a magnitude of harmonics, a magnitude of a component of a frequency that is included in sound collected by the microphone and that is n-times as large as the control frequency where n is not less than 2. The output level control unit controls the level of the noise canceling sound to be output from the noise control unit to the audio output unit such that, when the magnitude of the harmonics detected by the harmonics detection unit exceeds a predetermined threshold value, the magnitude of the harmonics does not become larger than the level of the noise canceling sound output from the noise control unit to the audio output unit at a time when the magnitude of the harmonics exceeds the predetermined threshold value.

The noise control system may be configured such that the harmonic detection unit detects at least a magnitude of a component of a frequency that is twice as large as the control frequency and that is included in the sound collected by the microphone and a magnitude of a component of a frequency that is three times as large as the control frequency and that is included in the sound collected by the microphone as a magnitude of harmonics.

The noise control system may be configured such that the noise control unit generates a noise canceling sound of the control frequency such that noise collected by the microphone is minimized.

In the noise control system, the noise control unit may include a first adaptive filter that receives a cosine signal of the control frequency as an input, a second adaptive filter that receives a sine signal of the control frequency as an input, and an adder that generates the noise canceling sound by adding an output of the first adaptive filter and an output of the second adaptive filter to each other. The first adaptive filter may determine sound collected by the microphone as an error signal and adapts a transfer function of the first adaptive filter to suppress the error signal, and the second adaptive filter may determine sound collected by the microphone as an error signal and adapts a transfer function of the second adaptive filter to suppress the error signal.

The noise control system may be mounted in an automobile and reduce sound of an engine of the automobile as the noise.

The control frequency detection unit may detect a fundamental frequency of the engine sound calculated based on a rotation speed of the engine as a control frequency.

According to the noise control system described above, as a magnitude of a component of harmonics of noise canceling sound included in sound collected by the microphone, an output level of the noise canceling sound is suppressed, and in addition, an output level of sound of harmonics is also suppressed.

Consequently, when changes in output characteristics of the speaker and the like caused by changes in environmental conditions, such as temperature, cause harmonic distortion in the output characteristics, abnormal sound of harmonics of the noise canceling sound heard by an occupant may be suppressed while a certain effect of the noise canceling using the noise canceling sound is maintained to some degree.

As described above, according to the present disclosure, a noise canceling system may be provided to suppress output of harmonic noise of noise canceling sound for canceling noise.

DETAILED DESCRIPTION OF THE PREFERRED EMBODIMENTS

Hereinafter, an embodiment of the present invention will be described.

Figure 1:
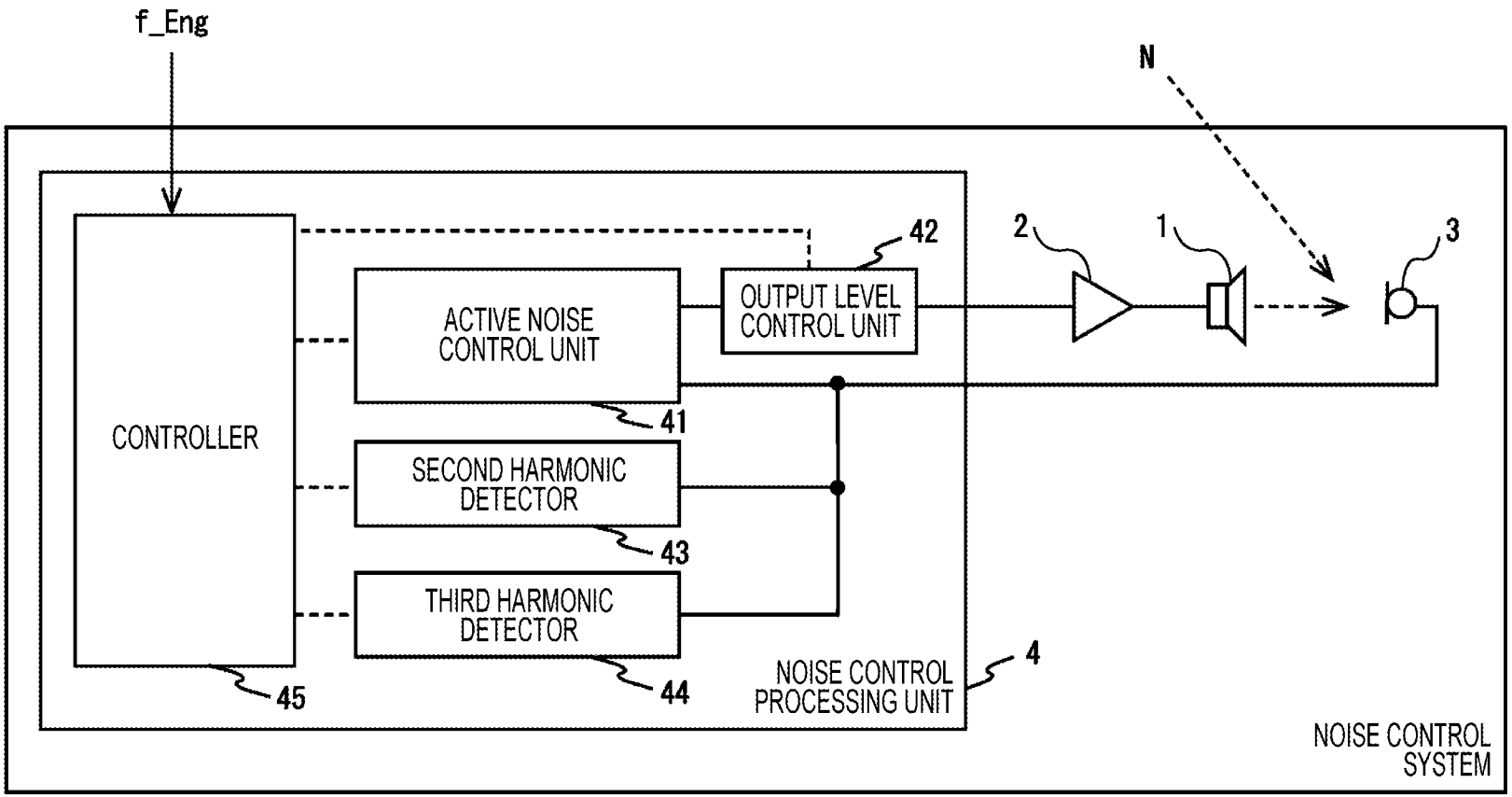
FIG. 1 is a block diagram illustrating a configuration of a noise control system according to an embodiment of the present invention.

FIG. 1 is a diagram illustrating a configuration of a noise control system according to the embodiment.

Here, the noise control system according to this embodiment indicates a device installed in an automobile and reduces an engine sound of the automobile heard as noise by an occupant.

As illustrated in FIG. 1, the noise control system includes a speaker 1, an amplifier 2 for driving the speaker 1, a microphone 3, and a noise control processing unit 4.

The noise control processing unit 4 includes an active noise control unit 41, an output level control unit 42, a second harmonic detector 43, a third harmonic detector 44, and a controller 45 that controls the individual units.

The active noise control unit 41, with reference to sound collected by the microphone 3 as an error signal, generates a noise canceling sound of a single frequency that minimizes the error signal, that is, a noise canceling sound of a single frequency that minimizes an engine sound heard by the occupant. The output level control unit 42 controls a level of the noise canceling sound generated by the active noise control unit 41 and outputs the sound to the speaker 1 via the amplifier 2.

The second harmonic detector 43 detects a magnitude of a second harmonic component that is twice as large as a frequency of the noise canceling sound included in the sound collected by the microphone 3. The third harmonic detector 44 detects a magnitude of a third harmonic component that is a frequency component three times as large as the frequency of the noise canceling sound included in the sound collected by the microphone 3.

The controller 45 controls a frequency of the noise canceling sound generated by the active noise control unit 41 to a fundamental frequency of an engine sound in accordance with a rotation frequency f_Eng of an engine of the automobile. Furthermore, the controller 45 causes the output level control unit 42 to control a level of the noise canceling sound to be output to the amplifier 2 so that the level of the noise canceling sound supplied to the amplifier 2 and the speaker 1 does not become higher, when a magnitude of the second harmonic component detected by the second harmonic detector 43 and a magnitude of the third harmonic component detected by the third harmonic detector 44 exceed a predetermined threshold value.

Figure 2:
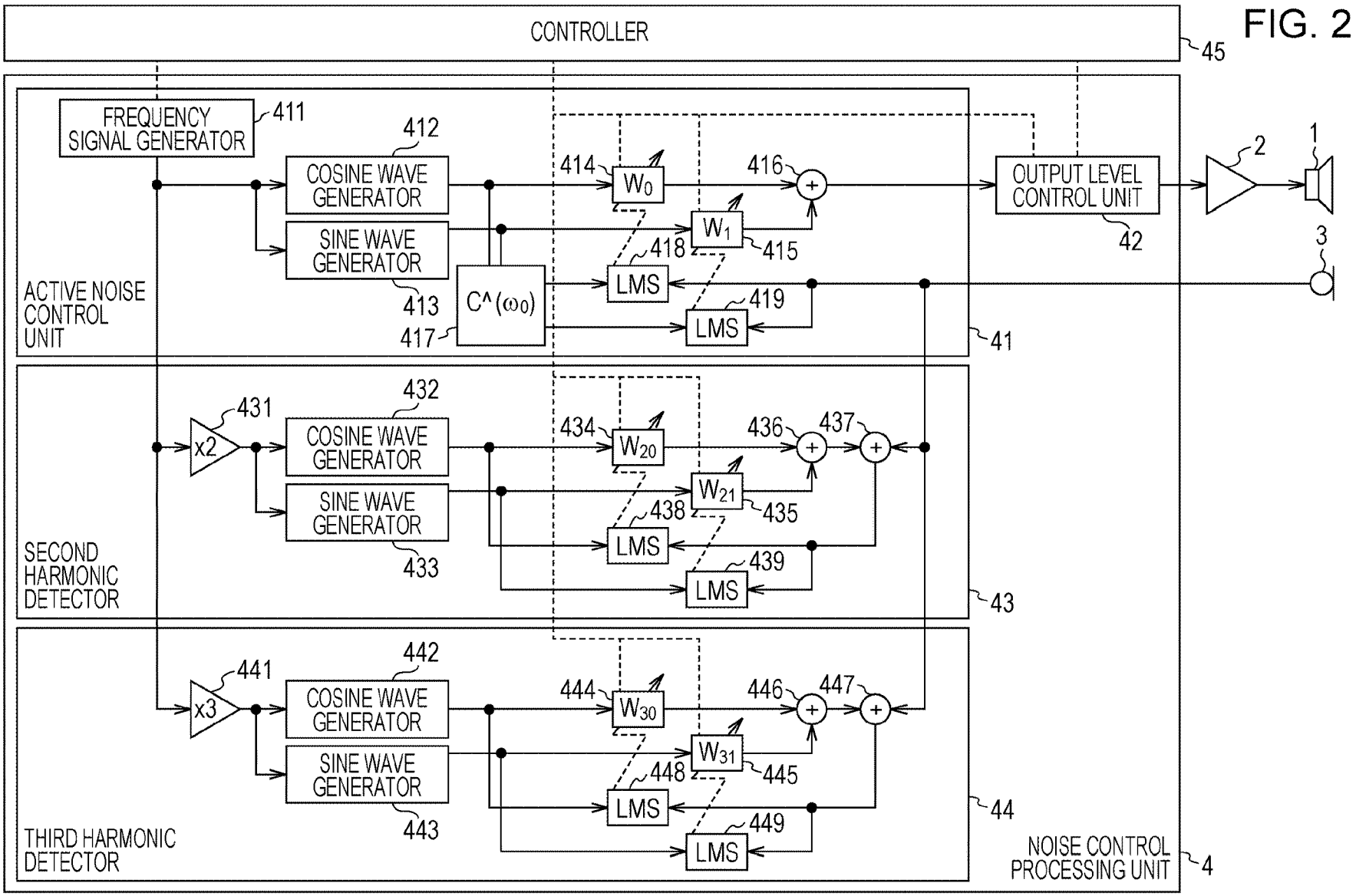
FIG. 2 is a block diagram illustrating a configuration of a noise control processing unit according to the embodiment of the present invention in more detail.

Next, FIG. 2 is a diagram illustrating an example of a configuration of the noise control processing unit 4 in more detail.

As illustrated in FIG. 2, in this configuration example, the active noise control unit 41 includes a frequency signal generator 411 that generates a periodic signal of having the same frequency as the fundamental frequency of the engine sound under control of the controller 45, a cosine wave generator 412 that generates a cosine wave signal that is synchronized with the periodic signal of and that has the same frequency as the periodic signal of $\omega_D$, a sine wave generator 413 that generates a sine wave signal having a phase different by $\pi/2$ radian from that of the cosine wave signal generated by the cosine wave generator 412, a filter $W_0$ 414 that convolves the cosine wave signal with a set filter coefficient $W_0$ and outputs the resultant cosine wave signal, a filter $W_1$ 415 that convolves the sine wave signal with a filter coefficient $W_1$ and outputs the resultant sine wave signal, and an adder 416 that adds the output of the filter $W_0$ 414 and the output of the filter $W_1$ 415 to each other and outputs a resultant value as a noise canceling sound.

The active noise control unit 41 further includes, as a configuration that updates the filter coefficient $W_0$ of the filter $W_0$ 414 and the filter coefficient $W_1$ of the filter $W_1$ 415 in accordance with the Filtered-x Algorithm, a transmission system model 417 that generates a reference signal by assigning an estimation transfer function CA in a range from the adder 416 to the microphone 3 to the cosine wave signal and the sine wave signal, an LMS 418 for $W_0$ that updates the filter coefficient $W_0$ of the filter $W_0$ 414, and an LMS 419 for $W_1$ that updates the filter coefficient $W_1$ of the filter $W_1$ 415. The LMS 418 for $W_0$ updates the filter coefficient $W_0$ of the filter $W_0$ 414 so as to minimize an error signal indicating the sound collected by the microphone 3 in a step corresponding to the reference signal generated by the transmission system model 417. The LMS 419 for $W_1$ updates the filter coefficient $W_1$ of the filter $W_1$ 415 so as to minimize an error signal indicating the sound collected by the microphone 3 in a step corresponding to the reference signal generated by the transmission system model 417.

By this operation, the filter coefficient $W_0$ of the filter $W_0$ 414 and the filter coefficient $W_1$ of the filter $W_1$ 415 are automatically adapted to generate a noise canceling sound that cancels the engine sound as much as possible.

Next, a second harmonic detector 43 includes a double frequency multiplier 431 that generates a frequency signal $2\omega_D$ of twice a frequency of a periodic signal $2\omega_D$, a double cosine wave generator 432 that generates a cosine wave signal of the same frequency as the periodic signal $2\omega_D$ in synchronization with the periodic signal $2\omega_D$, a double sine wave generator 433 that generates a sine wave signal having a phase different by a $\pi/2$ radian from that of the cosine wave signal generated by the double cosine wave generator 432, a filter $W_{20}$ 434 that convolves the cosine wave signal with a set filter coefficient $W_{20}$ and outputs a resultant signal, a filter $W_{21}$ 435 that convolves the sine wave signal with the filter coefficient $W_{21}$ and outputs a resultant signal, a double adder 436 that adds the output of the filter $W_{20}$ 434 and the output of the filter $W_{21}$ 435 to each other to generate a double comparison signal, a double difference detection adder 437 that generates a double difference signal by adding the double comparison signal to the sound collected by the microphone 3, an LMS 438 for $W_{20}$ that updates the filter coefficient $W_{20}$ of the filter $W_{20}$ 434, and an LMS 439 for $W_{21}$ that updates the filter coefficient $W_{21}$ of the filter $W_{21}$ 435. The LMS 438 for $W_{20}$ updates the filter coefficient $W_{20}$ of the filter $W_{20}$ 434 such that the double difference signal is minimized, and the LMS 439 for $W_{21}$ updates the filter coefficient $W_{21}$ of the filter $W_{21}$ 435 such that the double difference signal is minimized.

Here, by the operation of the second harmonic detector 43 described above, the filter coefficient $W_{20}$ and the filter coefficient $W_{21}$ are adapted so that a magnitude of the double comparison signal matches a magnitude of the second harmonic component included in the sound collected by the microphone 3.

Therefore, the magnitude of the double comparison signal represents the magnitude of the second harmonic component included in the sound collected by the microphone 3, and the double comparison signal may be represented as a sine wave having amplitude of one-half power of $(W_{20}^2+W_{21}^2)$ in accordance with a synthesis formula below, where amplitude of the cosine wave signal generated by the double cosine wave generator 432 and amplitude of the sine wave signal generated by the double sine wave generator 433 is 1.

$$A\sin(x)+B\cos(x)=(A^2+B^2)^{1/2}\sin(x+\text{constant})$$

Since a magnitude of the sound is represented by the square of amplitude of an effective value, $W_{20}^2+W_{21}^2$ may be used as an evaluation value representing a magnitude or a sound pressure level (dB) of the second harmonic component included in the sound collected by the microphone 3.

Next, the third harmonic detector 44 includes a triple frequency multiplier 441 that generates a periodic signal $3\omega_D$ having a frequency three times that of a periodic signal $3\omega_D$, a triple cosine wave generator 442 that is synchronized with a periodic signal $3\omega_D$ and that generates a cosine wave signal of the same frequency as a periodic signal $3\omega_D$, a triple sine wave generator 443 that generates a sine wave signal having a phase different by $\pi/2$ radian from that of the cosine wave signal generated by the triple cosine wave generator 442, a filter $W_{30}$ 444 that convolves the cosine wave signal with a set filter coefficient $W_{30}$ and outputs a resultant signal, a filter $W_{31}$ 445 that convolves the sine wave signal with the filter coefficient $W_{31}$ and outputs a resultant signal, a triple adder 446 that adds the output of the filter $W_{30}$ 444 and the output of the filter $W_{31}$ 445 to each other to generate a triple comparison signal, a triple difference detection adder 447 that adds the triple comparison signal and the sound collected by the microphone 3 to each other so as to generate a triple difference signal, an LMS 448 for $W_{30}$ that updates the filter coefficient $W_{30}$ of the filter $W_{30}$ 444, and an LMS 449 for $W_{31}$ that updates the filter coefficient $W_{31}$ of the filter $W_{31}$ 445. The LMS 448 for $W_{30}$ updates the filter coefficient of the filter $W_{30}$ 444 such that the triple difference signal is minimized, and the LMS 449 for $W_{31}$ updates the filter coefficient $W_{31}$ of the filter $W_{31}$ 445 such that the triple difference signal is minimized.

Here, by the operation of the third harmonic detector 44 described above, the filter coefficient $W_{30}$ and the filter coefficient $W_{31}$ are adapted so that a magnitude of the triple comparison signal matches a magnitude of the third harmonic component included in the sound collected by the microphone 3.

Then, as with $W_{20}^2+W_{21}^2$ of the second harmonic component, $W_{30}^2+W_{31}^2$ may be used as an evaluation value representing a magnitude or a sound pressure level (dB) of the third harmonic component included in the sound collected by the microphone 3.

Next, the output control process performed by the controller 45 will be described.

Figure 3:
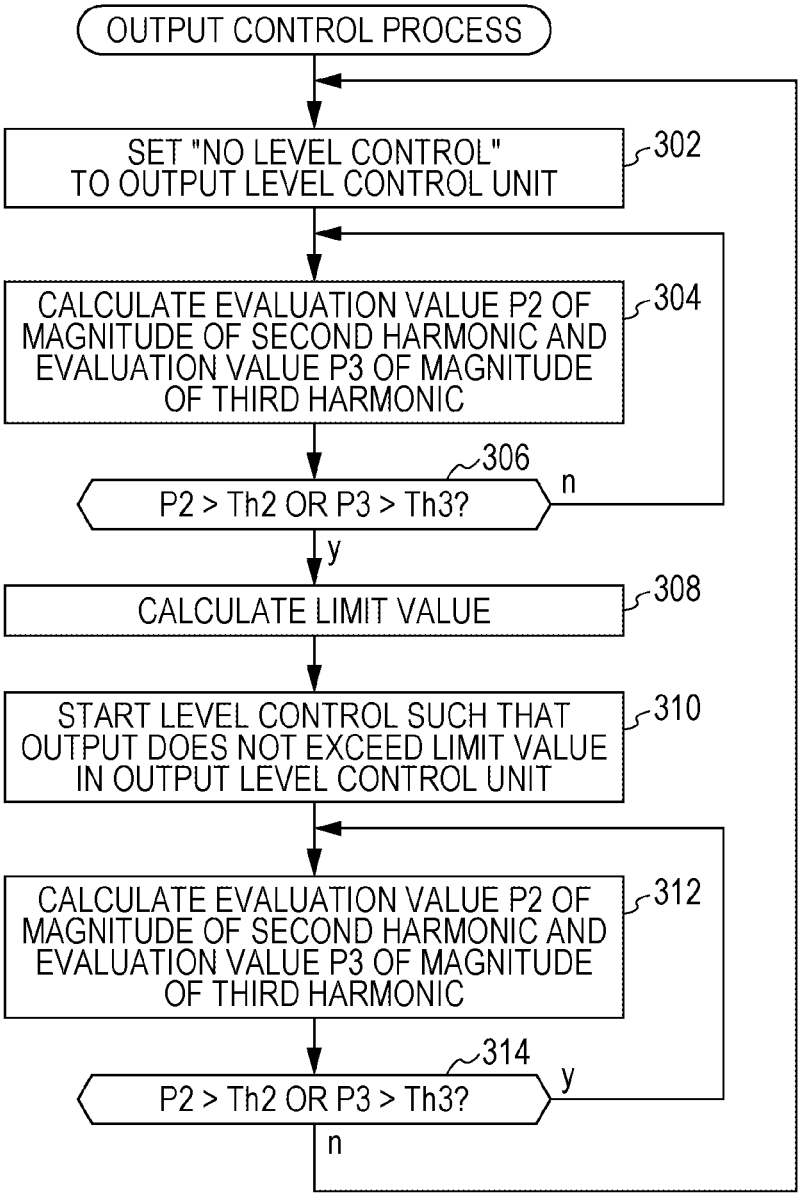
FIG. 3 is a flowchart of an output control process according to the embodiment of the present invention.

FIG. 3 is a flowchart of a procedure of the output control process.

As illustrated in the FIG. 3, in this process, the controller 45 first sets "no level control" to the output level control unit 42 (step 302).

Here, the output level control unit 42 outputs the noise canceling sound supplied from the noise control processing unit 4 to the amplifier 2 as it is during a period in which "no level control" is set.

Subsequently, an evaluation value P2 of a magnitude of the second harmonic component included in the sound collected by the microphone 3 and an evaluation value P3 of a magnitude of the third harmonic component included in the sound collected by the microphone 3 are calculated (step 304).

Here, in step 304, a configuration of the noise control processing unit 4 obtains, when the configuration illustrated in FIG. 2 is used, the filter coefficient $W_{20}$ of the filter $W_{20}$ 434 and the filter coefficient $W_{21}$ of the filter $W_{21}$ 435 so as to determine $W_{20}^2+W_{21}^2$ as the evaluation value P2, and in addition, obtains the filter coefficient $W_{30}$ of the filter $W_{30}$ 444 and the filter coefficient $W_{31}$ of the filter $W_{31}$ 445 so as to determine $W_{30}^2+W_{31}^2$ as the evaluation value P3.

Then, it is examined whether the evaluation value P2 is larger than a predetermined threshold value Th2 and whether the evaluation value P3 is larger than a predetermined threshold value Th3 (step 306), and when neither is large, the process returns to the process in step 304.

Here, the threshold value Th2 is determined as a value in which, when the current evaluation value P2 is larger than the value, the occupant may hear a sound having a frequency twice the frequency of the noise canceling sound output from the speaker 1 or is obtained by subtracting a predetermined margin from the value. The threshold value Th3 is determined as a value in which, when the evaluation value P3 is larger than the value, the occupant may hear a sound having a frequency three times the frequency of the noise canceling sound output from the speaker 1 or is obtained by subtracting a predetermined margin from the value.

On the other hand, when the evaluation value P2 is larger than the predetermined threshold value Th2, when the evaluation value P3 is larger than the predetermined threshold value Th3, or both (step 306), a current output level of the noise canceling sound from the active noise control unit 41 is calculated as a limit value (step 308).

Since the noise canceling sound output from the active noise control unit 41 may be represented as a sine wave having an amplitude of one-half power of $(W_0^2+W_1^2)$ where amplitude of the cosine wave signal generated by the cosine wave generator 412 and amplitude of the sine wave signal generated by the sine wave generator is 1, the current output level of the noise canceling sound output from the active noise control unit 41 may be calculated by obtaining the filter coefficient $W_0$ of the filter $W_0$ 414 and the filter coefficient $W_1$ of the filter $W_1$ 415 from the active noise control unit 41.

Thereafter, the calculated limit value is set to the output level control unit 42, and level control is started (step 310).

Here, when the level control is started, the output level control unit 42 controls a gain of the noise canceling sound such that a level of the noise canceling sound output to the amplifier 2 does not exceed the set limit value.

This control is performed, for example, when the level of the noise canceling sound input from the active noise control unit 41 exceeds the set limit value, by attenuating the noise canceling sound to a level that does not exceed the limit value and outputting the processed noise canceling sound to the amplifier 2. Moreover, in this case, the level of the noise canceling sound supplied from the active noise control unit 41 may be calculated by obtaining the filter coefficient $W_0$ of the filter $W_0$ 414 and the filter coefficient $W_1$ of the filter $W_1$ 415.

After that, the calculation of the evaluation value P2 of the magnitude of the second harmonic component included in the sound collected by the microphone 3 and the calculation of the evaluation value P3 of the magnitude of the third harmonic component included in the sound collected by the microphone 3 are repeatedly performed (step 312) until the evaluation value P2 becomes not larger than the threshold value Th2 and the evaluation value P3 becomes not larger than the threshold value Th3 (step 314). When the evaluation value P2 is not larger than the threshold value Th2 and the evaluation value P3 is not larger than the threshold, the process returns to the process in step 302.

The output control process performed by the controller 45 has been described above.

An operation of the output control process described above is illustrated in FIG. 4 taking a case where a frequency of the noise canceling sound is 40 Hz as an example.

Figure 4:
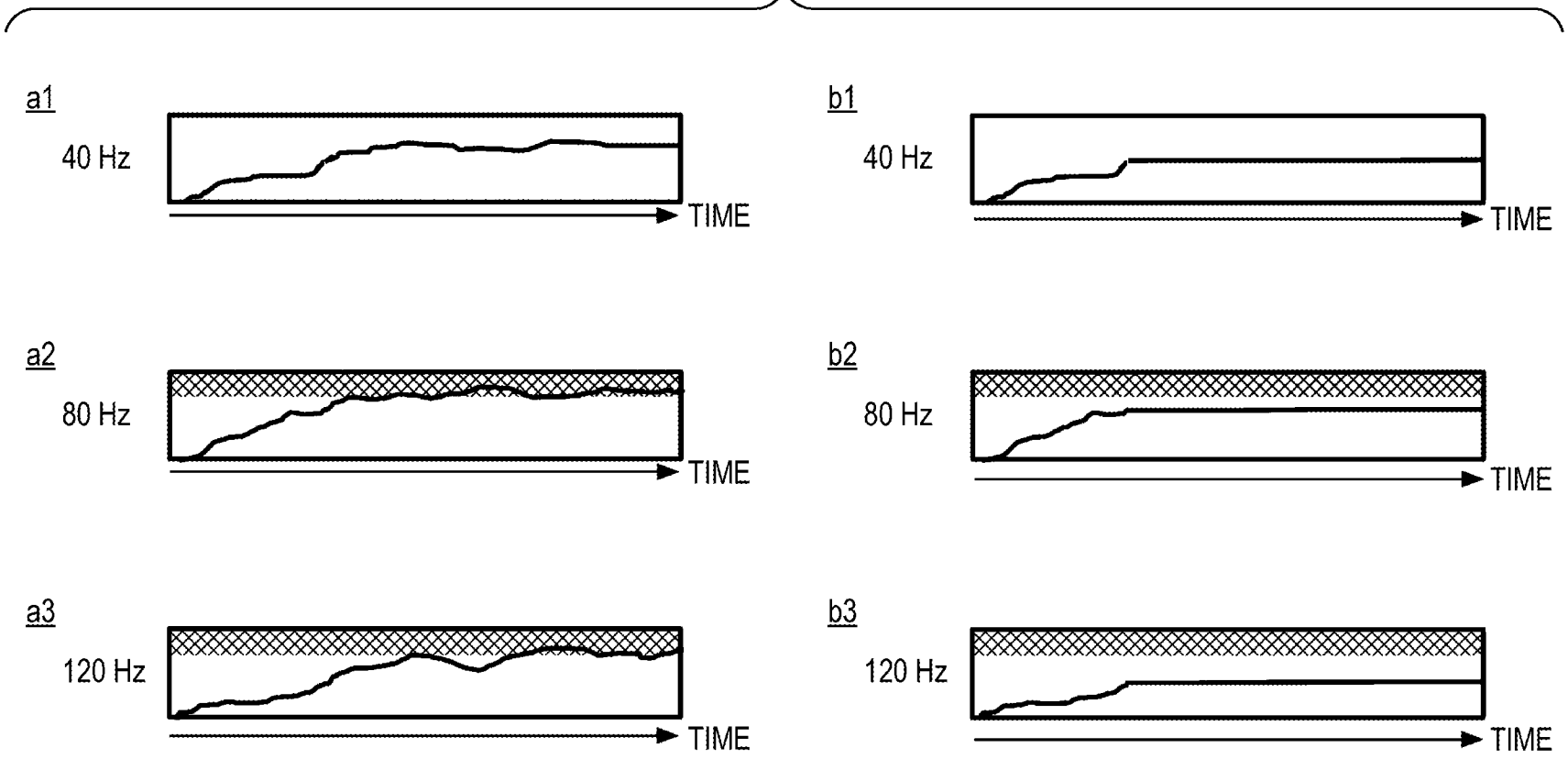
FIG. 4 is a diagram illustrating an output of a noise control system according to the embodiment of the present invention.

When the level control is not performed by the output level control unit 42, a sound of 80 Hz illustrated in a2 of FIG. 4 and a sound of 120 Hz illustrated in a3 of FIG. 4 which are harmonics are output in a high level hatched in FIG. 4 that reaches a region audible to the occupant in accordance with increase in the output level of the noise canceling sound of 40 Hz illustrated in a1 of FIG. 4. However, the level of the output of the noise canceling sound of 40 Hz is suppressed by the level control performed by the output level control unit 42 as illustrated in b 1 of FIG. 4, and therefore, the level of the sound of 80 Hz and the level of the sound of 120 Hz which are the harmonics are also suppressed not to reach the region audible to the occupant.

Furthermore, even when the output level of the noise canceling sound of 40 Hz is suppressed in this way, a certain effect of the canceling of the engine sound may be obtained.

The embodiment of the present invention has been described above.

Note that, although only the components of the second harmonics and the third harmonics of the noise canceling sound are considered in the embodiment described above, components of higher harmonics may also be considered.

Furthermore, although the output level control unit 42 is provided so as to control the level of the noise canceling sound generated by the active noise control unit 41 in the description above, the output level control unit 42 may individually control the output level of the filter $W_0$ 414 of the active noise control unit 41 and the output level of the filter $W_1$ 415 of the active noise control unit 41. In this case, the control is performed such that amplitude of the output of the filter $W_0$ 414 does not exceed the filter coefficient $W_0$ at the time of setting of the limit value and amplitude of the output of the filter $W_1$ 415 does not exceed the filter coefficient $W_1$ at the time of setting of the limit value in the output level control unit 42, where amplitude of the cosine wave signal generated by the cosine wave generator 412 and amplitude of the sine wave signal generated by the sine wave generator 413 are set to 1.

Furthermore, the above embodiment may be similarly applied to a case of reduction of noise other than engine noise.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A noise control system that reduces noise, comprising:

an audio output unit configured to include a speaker;

a control frequency detection unit configured to detect a single frequency serving as a main frequency of the noise as a control frequency;

a noise control unit configured to generate noise canceling sound signal of the control frequency that cancels the noise and output the generated noise canceling sound signal to the audio output unit so as to output noise canceling sound from the speaker;

an output level control unit configured to control a level of the noise canceling sound signal to be output from the noise control unit to the audio output unit;

a microphone; and a harmonic detection unit configured to detect, as a magnitude of harmonics, a magnitude of a component of a frequency that is included in sound collected by the microphone and that is n-times as large as the control frequency where n is not less than 2, wherein the output level control unit controls the level of the noise canceling sound signal to be output from the noise control unit to the audio output unit such that, when the magnitude of the harmonics detected by the harmonics detection unit exceeds a predetermined threshold value, the magnitude of the harmonics does not become larger than the level of the noise canceling sound output from the noise control unit to the audio output unit at a time when the magnitude of the harmonics exceeds the predetermined threshold value.

2. The noise control system according to claim 1, wherein the harmonic detection unit detects at least a magnitude of a component of a frequency that is twice as large as the control frequency and that is included in the sound collected by the microphone and a magnitude of a component of a frequency that is three times as large as the control frequency and that is included in the sound collected by the microphone as a magnitude of harmonics.

3. The noise control system according to claim 2, wherein the noise control unit generates a noise canceling sound signal of the control frequency such that noise collected by the microphone is minimized.

4. The noise control system according to claim 3, wherein the noise control system is mounted in an automobile and reduces sound of an engine of the automobile as the noise.

5. The noise control system according to claim 4, wherein the control frequency detection unit detects a fundamental frequency of the engine sound calculated based on a rotation speed of the engine.

6. The noise control system according to claim 2, wherein the noise control unit includes a first adaptive filter that receives a cosine signal of the control frequency as an input, a second adaptive filter that receives a sine signal of the control frequency as an input, and an adder that generates the noise canceling sound signal by adding an output of the first adaptive filter and an output of the second adaptive filter to each other, and the first adaptive filter determines sound collected by the microphone as an error signal and adapts a transfer function of the first adaptive filter to suppress the error signal, and the second adaptive filter determines sound collected by the microphone as an error signal and adapts a transfer function of the second adaptive filter to suppress the error signal.

7. The noise control system according to claim 6, wherein the noise control system is mounted in an automobile and reduces sound of an engine of the automobile as the noise.

8. The noise control system according to claim 7, wherein the control frequency detection unit detects a fundamental frequency of the engine sound calculated based on a rotation speed of the engine as a control frequency.

9. The noise control system according to claim 2, wherein the noise control system is mounted in an automobile and reduces sound of an engine of the automobile as the noise.

10. The noise control system according to claim 9, wherein the control frequency detection unit detects a fundamental frequency of engine sound calculated based on a rotation speed of the engine as the control frequency.

11. The noise control system according to claim 1, wherein the noise control system is mounted in an automobile and reduces sound of an engine of the automobile as the noise.

12. The noise control system according to claim 11, wherein the control frequency detection unit detects a fundamental frequency of engine sound calculated based on a rotation speed of the engine as the control frequency.

13. A noise control system that reduces noise, comprising:

an audio output unit configured to include a speaker;

a control frequency detection unit configured to detect a single frequency serving as a main frequency of the noise as a control frequency;

a noise control unit configured to generate noise canceling sound signal of the control frequency that cancels the noise and output the generated noise canceling sound signal to the audio output unit so as to output noise canceling sound from the speaker;

an output level control unit configured to control a level of the noise canceling sound signal to be output from the noise control unit to the audio output unit;

a microphone; and a harmonic detection unit configured to detect, as a magnitude of harmonics, a magnitude of a component of a frequency that is included in sound collected by the microphone and that is n-times as large as the control frequency where n is not less than 2, wherein the output level control unit controls the level of the noise canceling sound signal to be output from the noise control unit to the audio output unit such that, when the magnitude of the harmonics detected by the harmonics detection unit exceeds a predetermined threshold value, the magnitude of the harmonics does not become larger than the level of the noise canceling sound output from the noise control unit to the audio output unit at a time when the magnitude of the harmonics exceeds the predetermined threshold value; and wherein the noise control unit includes a first adaptive filter that receives a cosine signal of the control frequency as an input, a second adaptive filter that receives a sine signal of the control frequency as an input, and an adder that generates the noise canceling sound signal by adding an output of the first adaptive filter and an output of the second adaptive filter to each other, and the first adaptive filter determines sound collected by the microphone as an error signal and adapts a transfer function of the first adaptive filter to suppress the error signal, and the second adaptive filter determines sound collected by the microphone as an error signal and adapts a transfer function of the second adaptive filter to suppress the error signal.

14. The noise control system according to claim 13, wherein the noise control system is mounted in an automobile and reduces sound of an engine of the automobile as the noise.

15. The noise control system according to claim 14, wherein the control frequency detection unit detects a fundamental frequency of engine sound calculated based on a rotation speed of the engine as the control frequency.

16. The noise control system according to claim 1, wherein the noise control unit generates a noise canceling sound signal of the control frequency such that noise collected by the microphone is minimized.

17. A noise control method that reduces noise, comprising:

detecting a frequency serving as a main frequency of the noise as a control frequency;

generating noise canceling sound signal of the control frequency and outputting the generated noise canceling sound signal to a speaker to output noise canceling sound;

detecting, as a magnitude of harmonics, a magnitude of a component of a frequency that is included in sound collected by a microphone and that is n-times as large as the control frequency where n is not less than 2; and controlling the level of the generated noise canceling sound signal such that, when the detected magnitude of the harmonics exceeds a predetermined threshold value, the magnitude of the harmonics does not become larger than the level of the noise canceling sound at a time when the magnitude of the harmonics exceeds the predetermined threshold value.

18. The noise control method according to claim 17, wherein the detecting step detects at least a magnitude of a component of a frequency that is twice as large as the control frequency and that is included in the sound collected by the microphone and a magnitude of a component of a frequency that is three times as large as the control frequency and that is included in the sound collected by the microphone as a magnitude of harmonics.

19. The noise control method according to claim 18, wherein the step of generating noise canceling sound signal comprising adding an output of a first adaptive filter that receives a cosine signal of the control frequency as an input and an output of a second adaptive filter that receives a sine signal of the control frequency as an input, and the first adaptive filter determines sound collected by the microphone as an error signal and adapts a transfer function of the first adaptive filter to suppress the error signal, and the second adaptive filter determines sound collected by the microphone as an error signal and adapts a transfer function of the second adaptive filter to suppress the error signal.

20. The noise control method according to claim 19, wherein the noise control method reduces sound of an engine of an automobile as the noise, and the frequency detection step detects a fundamental frequency of the engine sound based on a rotation speed of the engine as a control frequency.

* * * * *